United States Patent [19]

Ferro et al.

[11] Patent Number: 4,998,404

[45] Date of Patent: Mar. 12, 1991

[54] METHOD AND DEVICE FOR REMOVING DETERIORATED FIBRES DURING YARN REJOINING IN AN OPEN-END SPINNING MACHINE

[75] Inventors: Francesco Ferro; Claudio Peruch, both of Pordenone, Italy

[73] Assignee: Savio S.p.A., Pordenone, Italy

[21] Appl. No.: 409,676

[22] Filed: Sep. 20, 1989

[30] Foreign Application Priority Data

Dec. 23, 1988 [IT] Italy ..... 23095 A/88

[51] Int. Cl.[5] ..... D01H 4/32; D01H 4/50

[52] U.S. Cl. ..... 57/263; 57/411

[58] Field of Search ..... 57/263, 302, 404, 405, 57/408, 411, 413, 415

[56] References Cited

U.S. PATENT DOCUMENTS

| | | | |
|---|---|---|---|
| 3,354,626 | 11/1967 | Cizek et al. . | |
| 3,541,774 | 11/1970 | Sterba et al. . | |
| 3,557,543 | 1/1971 | Krause | 57/413 X |
| 3,604,194 | 9/1971 | Edagawe et al. | 57/413 X |
| 3,698,174 | 10/1972 | Boucek et al. . | |
| 3,728,853 | 4/1973 | Schiltknecht . | |
| 3,810,352 | 5/1974 | Miyazaki et al. | 57/302 X |
| 3,908,134 | 9/1975 | Mikulecky et al. . | |
| 3,950,926 | 4/1976 | Stahlecker | 57/263 |
| 3,987,610 | 10/1978 | Stahlecker et al. . | |
| 4,022,011 | 5/1977 | Hirai . | |
| 4,384,451 | 5/1983 | Elias et al. | 57/263 |
| 4,429,522 | 2/1984 | Ferkl et al. | 57/411 X |
| 4,497,166 | 2/1985 | Artzt et al. | 57/263 |
| 4,676,059 | 6/1987 | Artzt et al. | 57/263 |

FOREIGN PATENT DOCUMENTS

| | | | |
|---|---|---|---|
| 311946 | 4/1989 | European Pat. Off. | 57/411 |
| 3436295 | 10/1984 | Fed. Rep. of Germany . | |
| 2260644 | 2/1975 | France . | |
| 8601235 | 2/1986 | PCT Int'l Appl. . | |
| 1074788 | 7/1967 | United Kingdom . | |
| 2069014 | 8/1987 | United Kingdom . | |

*Primary Examiner*—Joseph J. Hail, III

*Attorney, Agent, or Firm*—Hedman, Gibson, Costigan & Hoare

[57] ABSTRACT

A method for rejoining yarn in an open-end spinning machine in which the rejoining is effected by feeding intact fibres to the rotor but preceding the rejoining by an operation in which the sliver is cleared and the carder is cleaned by the pneumatic action of a blowing nozzle brought into correspondence with the air intake port.

17 Claims, 2 Drawing Sheets

METHOD AND DEVICE FOR REMOVING DETERIORATED FIBRES DURING YARN REJOINING IN AN OPEN-END SPINNING MACHINE

FIELD OF THE INVENTION

This invention relates to a method of yarn rejoining in open-end spinning machines, and more particularly to a method of preparing the fibre sliver which forms the feed before joining or rejoining the yarn to enable spinning to restart.

Background of the Invention

The open-end spinning process consists essentially of the following stages:

- feeding the fibre sliver to the spinning station by a feed roller;
- unravelling the sliver by a toothed carder which rotates at high speed and separates the sliver into individual fibres;
- pneumatically feeding the individual fibres to the hollow spinning rotor which is provided with an inner groove within which the fibres are deposited in layers by the effect of the centrifugal force generated by the rotor rotating at very high speed;
- an already formed yarn is initially inserted through the a channel located substantially on the axis of rotation of the rotor, centrifugal force propelling its free end to the periphery, i.e. into the groove where it encounters the fibre layer; on drawing out the yarn the fibres become joined to the yarn, acquiring twist in the section between the groove and the exit channel to produce new yarn.

In the known art the spinning machine is provided with yarn-feeling sensors which for every yarn breakage cause the fibre sliver feed roller to stop, as for example in Italian Pat. No. 791,993 of VUB.

However the separating carder continues to rotate even if yarn production is interrupted.

In the known art the method used for rejoining the yarn and restarting production comprises firstly cleaning the spinning rotor, in which irregularities or dirt build-up have probably occurred.

This cleaning is done either by opening the roller, clamping it and then using suitable tools such as brushes, suction nozzles, spatulas etc., or by keeping the roller closed and using an air blast.

After cleaning, a fibre layer suitable for forming new yarn is rebuilt in the spinning rotor while under movement, and the interrupted yarn end is reinserted when the rotor has reached suitable speed, to "fish out" this fibre layer and again produce yarn.

This operation is conducted either manually, in non-automated spinning machines, or automatically by devices located for example on mobile carriages which patrol the plurality of spinning stations along the machine face in the case of automated machines, as described in U.S. Pat. Nos. 3,810,352 and 3,950,926.

A technical problem common to both automated and non-automated spinning machines is that the fibre feed sliver which has been halted on yarn breakage, with its feed roller at rest, remains with its end exposed to the action of the separating carder. Generally, the rejoining operation is commenced with variable delay because the rejoining operation requires in the case of non-automated spinning machines the operator, or in the case of automated spinning machines the carriage, to arrive in front of the spinning station at which the operation is to be carried out. The operator or carriage can be a variable distance away, or may be engaged in other operations.

During this variable waiting time the end of the feed sliver continues to undergo separation, without advancing, and is depleted of fibres, which are gradually removed by the carder teeth.

When the sliver is reused in that state for restarting the spinning, the fibre layer newly deposited in the rotor groove and used for rejoining purposes gives rise to thinner or fatter weakened portions and thus an irregular joint, with the result that the produced yarn is of poor quality.

The sliver depletion varies in accordance with the waiting time for commencing the operation, and the layer initially deposited in the rotor groove consequently varies.

According to the known art this variability in the consistency of the fibre sliver re-fed to spinning is overcome by means of a brief prefeed of sliver during the initial stage of the rejoining operation.

This prefeed enables the state of the sliver to be equalized by consuming that portion of sliver which in the meantime has remained exposed to the action of the carder, so restoring the state of the sliver as if the yarn breakage had taken place at the moment the rejoining operation commences.

This prefeed operation to equalize the state of the sliver end which is to be used for rejoining the yarn must necessarily be effected after the arrival of the operator or mobile carriage but before the rotor cleaning operation. The fibres removed from the deteriorated sliver during the waiting time for the operation are deposited in the rotor groove and are removed from there by the subsequent cleaning, whereas if the preliminary feed were to be effected after the rotor cleaning, this latter would not accomplish its purpose because uncontrolled depositing of other fibres would take place in the cleaned rotor.

Again, if the preliminary feed were to be effected with the rotor open it would give rise to unacceptable soiling.

The practice of prefeed goes back to the first open-end spinning machines and was already described in the book Open-End Spinning by Rohlena et al., 1974, pages 323 onwards, as a preliminary stage.

According to Italian Pat. No. 1,045,600 in the name of Stahlecker, this prefeed is effected during the braking of the spinning rotor.

In this patent the sliver feed roller is operated for prefeed purposes by an auxiliary motor positioned on the mobile carriage because during the rejoining operation this feed roller is disconnected from its normal drive, which is used only during spinning.

The practice of prefeeding the sliver, whether effected as the preliminary stage of the rejoining cycle or during rotor braking, satisfies its purpose of equalizing the state of the sliver re-fed to enable spinning to resume by the rejoining operation, but does not completely solve the problem of its deterioration.

In this respect it must be remembered that after the equalization to produce a constant sliver not influenced by the variable waiting time to the commencement of the rejoining operation, the sliver remains at rest and exposed to the action of the carder, which continues to rotate, for the time period between the sliver prefeed and the return to normal feeding to deposit the new fibre layer for rejoining purposes.

The duration of this time interval is rigorously constant in the case of automated spinning machines in which the rejoining operation is robotized and generally carried out by a mobile carriage, and substantially constant where the operation is carried out by an operator who has acquired sufficient manual ability.

During this constant time interval the sliver is subjected to deterioration by the carder. This deterioration is a drawback which is not very important from the point of view of the quantity of residual fibres present in the end of the sliver because this can be remedied by controlling the time interval between the restoration of sliver feed and the "fishing out" of the fibre layer in the rotor cavity by the yarn end.

This drawback cannot however be totally overlooked from the point of view of the quality of the residual fibres present in the sliver end.

It must be remembered that the duration of the interval between prefeed and restoration of spinning in current automated open-end spinning machines is of the order of 10 seconds, and the carder has therefore a considerable time available for this deterioration action on the end of the halted sliver.

In this respect it has been found that one of the most important causes of defective joining, even using the prefeed practice, is that the sliver end, which remains subjected to the action of the carder for the entire duration of the said interval, is also subjected to qualitative deterioration because the sliver fibres are not only removed but also shortened, so that the new fibre layer deposited in the rotor cavity on restoring the sliver feed and which is used for the actual rejoining is formed from fibres of inferior quality as it also comprises a considerable amount of fibres shortened by the action of the carder rotating on the sliver which is at rest during the waiting time for the rejoining. This drawback is particularly marked if fine yarns of high metric count are produced, for which the prefeed practice does not allow a reliable joint of good quality. The joining operation must be frequently repeated because the joint is not made or breaks. In Italian Pat. Nos. 1,169,043 and 1,178,550 of V.U.B. it is proposed to firstly deviate during the rejoining operation those fibres of the damaged portion of the sliver exposed to the action of the carder during the waiting period by not allowing them to reach the spinning rotor, so allowing the spinning rotor to receive only the undamaged fibres of the sliver portion which was not under the action of the separating carder while at rest.

According to Italian Pat. No. 1,169,043 this deviation is done by suction channels which open into the pneumatic conveying path which the fibres separated by the carder take in travelling to the rotor, and by blowing nozzles which act against the normal motion of the fibres towards the rotor.

This device results in considerable complications both in the spinning device and in its operation.

In the subsequent Italian Pat. No. 1,178,550 the deviation is done by using the aperture in the duct tangential to the carder to remove the impurities. The impurities, such as dust, sand and dirt, are more subject to the action of centrifugal force as they are heavier and more compact than the separated fibres.

The impurities are thus projected outwards through this tangential duct which connects to a suction manifold in which a slight vacuum is maintained sufficient to induce an air stream powerful enough to convey the impurities but not to suck the fibres from the carder.

This vacuum is by way of example a few tens of mm. of water column or a few mm. of mercury expressed as static vacuum.

The various suction manifolds converge into a large central duct under vacuum which collects all impurities and conveys them to a collection box and distributes the suction to the various spinning units. According to U.S. Pat. No. 1,178,550 a tubular suction nozzle is inserted into the suction manifold until is mouth engages the aperture of the tangential duct to shut off the suction manifold, and after it has been inserted in position the suction is applied to the damaged fibres.

This method is not free of drawbacks because the suction nozzle carried by the service carriage must be carefully constructed and positioned with great accuracy relative to the spinning station, and in addition travels a long distance in positioning itself and withdrawing, so extending the duration of the rejoining cycle. In addition there is disturbance to the initial spinning conditions, both due to the lack of suction for the impurities precisely during and immediately after the rejoining operation when the suction nozzle withdraws to its rest position to again engage the frontal air intake, and due to the consequent pressure pulsations which arise when the air intake is released.

SUMMARY OF THE INVENTION

The present invention provides a device and improved method of rejoining yarn in an open-end spinning machine which enables the rotor to be supplied with totally intact and impurity-free fibres for the rejoining operation.

BRIEF DESCRIPTION OF THE DRAWINGS

The device and method are described with reference to

DETAILED DESCRIPTION OF THE INVENTION

Figure 1:
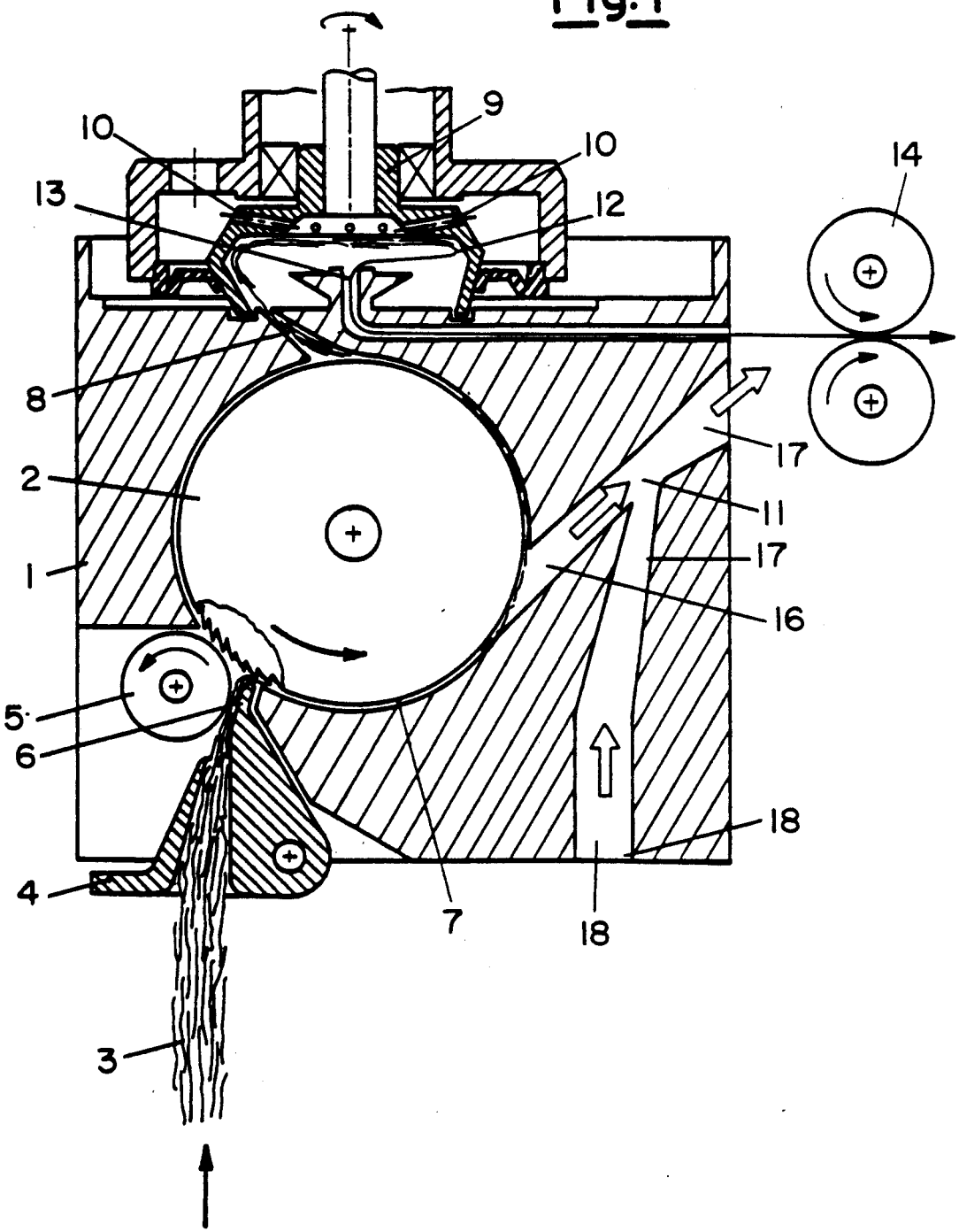
FIG. 1 which shows a spinning unit during its normal operation.
Figure 2:
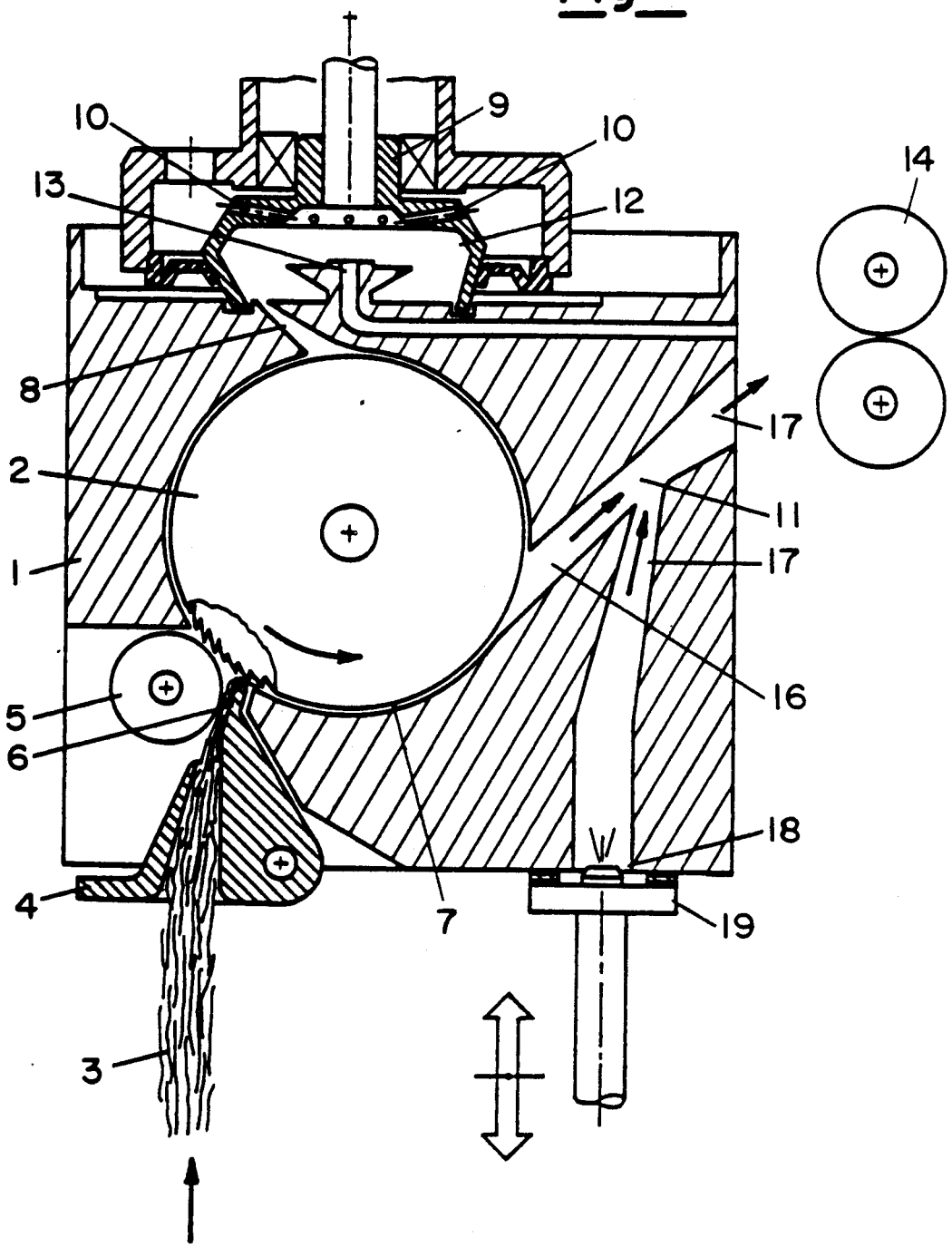
FIG. 2 which shows the spinning unit during the rejoining cycle.

The spinning unit consists of a fixed support 1 in which the rotary carder 2 is positioned, provided along its outer cylindrical surface with saw-toothing to separate the fibres of the feed sliver.

The fibre sliver 3, originating from an underlying chamber not shown on the figure, is fed along a fixed guide 4 by the feed roller 5 which rotates in an anticlockwise direction in order to feed the sliver towards the carder 2. The feed roller 5 is preferably provided with knurling on its cylindrical surface to increase the dragging effect on the sliver, contact between the sliver 3 and roller 5 being ensured by an approach member 6 the surface of which is kept in proximity to, but not in contact with, the cylindrical surface of the roller 5 by a suitable pneumatic or elastic device not shown on the figure, so that the sliver 3 is guided into contact with the cylindrical surface of the roller 5. In the practical embodiment the approach member 6 is a sliding block with a concave surface facing the roller 5.

In this manner the sliver 3 is fed to the carder 2, which separates it into individual fibres. The individual fibres travel through the interspace 7 surrounding the carder 2 and are conveyed pneumatically through the channel 8 to the cavity of the rotor 9, which rotates at very high speed.

A vacuum is generated within the cavity of the rotor 9 by the effect of its speed and the perforations 10, or by the action of a separate suction source, and sucks the fibres separated by the carder 2, withdrawing air from both the interspace 7 and channel 8 through the aperture 11.

Inside the rotor 9 the fibres are subjected to high centrifugal force and are urged towards the periphery where they collect in the annular groove 12 to form a layer of suitable size. An already formed yarn is then inserted through the channel 13 at the commencement of spinning. Its free end is urged by centrifugal force to the periphery of the rotor where it encounters the fibre layer, the yarn then being withdrawn for example by a pair of rollers 14. The fibres join to the inserted yarn and acquire twist along the path between the annular groove and the axis of the rotor 9, where the exit channel 13 is located.

The produced yarn 15 is extracted and collected in packages or bobbins by a collection system, not shown on the figure. The impurities which escape the carder 2 are discharged by centrifugal force from the aperture 11, which connects the tangential duct 16 to the suction manifold 17.

Conveying air is drawn into the manifold 17 through the air intake 18 by the effect of the vacuum downstream of the manifold 16, indicatively about 50 mm of water, in the direction of the light arrows.

When a breakage occurs in the yarn 15, a sensor not shown on the figure causes the feed roller 5 to stop and halts collection of the yarn 15 in known manner.

The yarn-feeling sensor also calls the service carriage to the spinning station in which yarn breakage has taken place, to effect the yarn rejoining operations in accordance with the cycle described heretofore.

During the intervention cycle the roller 5 remains at rest and the end of the sliver 3 is progressively depleted and degraded by the carder 2, which continues to rotate.

At the same time the rotor 9 is halted to enable its groove 12 to be cleaned. Thus the pneumatic conveying action in the duct 8 which sucks the fibres from the duct 8 to the rotor 9 ceases, and the fibres removed from the sliver by the rotary carder at least partly remain on the carder and in the interspace 7.

According to the present invention, for the yarn rejoining operation a high-pressure blowing nozzle 19 carried on the service carriage is brought into correspondence with the air intake port 18 and is able to approach and withdraw from the spinning unit in accordance with the double-direction light arrows.

When the rotor has been cleaned and before returning it to the speed at which the new fibre layer is to be deposited for the actual rejoining operation, a stream of pressurised air is fed by the action of a solenoid valve, not shown on the figure, positioned upstream of the nozzle 19.

The end of the nozzle 19 is formed in such a manner as to adapt to the mouth of the air intake port 18, for example with a conical flare and/or with soft gaskets which provide a sufficient sealing action.

The pressurised air stream thus used results in an energetic withdrawal of air from the interspace 7 through the aperture 11, to produce a vacuum which is much higher than that maintained in 17 during normal operation.

This withdrawal can be enhanced by making the connection between the duct 17 and aperture 11 of venturi shape, with the throat at the aperture 11.

The levels of static vacuum which enable a good joint to be made are indicatively between 300 and 900 mm of water and preferably between 450 mm and 700 mm at the aperture 11, and correspond to pressures at 18 of a few meters of water.

This energetic suction action allows removal from the carder 2 and interspace 7 of all the fibres deposited there during the stages preceding the intervention cycle, i.e. those in which the sliver was deteriorated by the action of the carder 2 and in which the pneumatic suction action in the duct 8 was no longer effective. The sudden increase in air speed in the duct 17 also allows all impurities which had deposited there during normal operation to be removed.

After the commencement of blowing by the nozzle 19, the sliver 3 is again fed by the roller 5 to the carder 2 while maintaining the energetic withdrawal of air from the interspace 7, and the rotor is restarted.

The deteriorated fibres present at the end of the sliver are thus combed away by the carder 2, drawn towards the aperture 11 and discharged into the manifold 17 without letting them reach the duct 8. After removing the deteriorated portion to a length of the order of 10–40 mm the air blast through the nozzle 19 is shut off by its solenoid valve and the normal vacuum is restored in 17 by withdrawing the nozzle 19. When the action of the air flow ceases in 17, the fibres separated by the carder 2 again flow through the duct 8 to the rotor 9, which in the meantime has reached the required speed for depositing the new layer of fibres and has restored its pneumatic suction action.

As can be seen, the nozzle 19 does not have to travel long distances or be accurately positioned. All the discharged material is conveyed into a single collection duct.

The time required for cleaning the carder 2 and interspace 7 and for removing the damaged fibres from the sliver is very short, with an indicative total of less than 7 seconds.

Using the method of the invention, effective joints of good appearance have been obtained even on fine yarns, and with a very high percentage of positive results.

We claim:

1. A method of rejoining a separated length of yarn in an open-end spinning machine, wherein the spinning machine comprises a feeding mechanism, a cavity having an aperture, and a rotatable carder, a channel connected to the aperture, and a spinning rotor; wherein sliver is fed by the feeding mechanism to the rotatable carder for producing combed fibers, and the combed fibers are fed from the rotatable carder to the rotor for creating a ring of fibers for forming a length of yarn; the method comprising:

(a) removing fibers from the cavity and from the sliver by withdrawing air through the aperture by a fiber withdrawal means which blows air through the channel;

(b) depositing the combed fibers into the rotor groove after step (a) has been completed; and (c) inserting the separated length of yarn into the rotor groove so that an end of the separated length of yarn contacts the ring of fibers to form a continuous length of yarn from the separated length of yarn.

2. The method of claim 1, further comprising starting removing fibers by the withdrawal means prior to the rotor reaching full operational speed and prior to the feeding mechanism feeding sliver to the carder, and operating the withdrawal means until the rotor has reached the speed at which fibers are fed from the carder.

3. The method of claim 2, wherein the air blown through the channel creates a vacuum in the aperture in the range of about 300–900 mm of water.

4. The method of claim 3, wherein the air blown through the aperture creates a vacuum in the aperture in the range of 450–700 mm of water.

5. The method of claim 1, wherein the air blown through the channel creates a vacuum in the aperture in the range of about 300–900 mm of water.

6. The method of claim 5, wherein the air blown through the channel creates a vacuum in the aperture in the range of about 450–700 mm of water.

7. The method of claims 1, 2, 3, 4, 5 or 6, wherein the withdrawal means is operated for from 1 to 7 seconds.

8. A method of spinning fibers from sliver into a continuous length of yarn, and for rejoining the yarn to the fibers in an open-end spinning machine, comprising:

(a) feeding the sliver to the machine by means of a feeding mechanism;

(b) receiving the sliver from said feeding mechanism and combing the sliver into fibers by means of a rotatable carder;

(c) receiving the fibers from said rotatable carder and forming a ring of fibers in a rotor from which the continuous length of yarn is formed;

(d) withdrawing impurities from the sliver and from the combed fibers through a first channel; and (e) creating a vacuum in said first channel by blowing air through a second channel connected to said first channel so that said impurities and fibers from the cavity and from the sliver can be withdrawn through said first channel by means of a fiber and impurity withdrawal mechanism which blows said air through said second channel, so that yarn can be rejoined to a newly deposited ring of fibers and to provide the desired fibers to said rotor when said fiber and impurity withdrawal mechanism ceases blowing said air.

9. The method of claim 8, further comprising starting removing fibers by the withdrawal means prior to the rotor reaching full operational speed and prior to the feeding mechanism feeding sliver to the carder, and operating the withdrawal means until the rotor has reached the speed at which fibers are fed from the carder.

10. The method of claim 9, wherein the air blown through said second channel creates a vacuum in said first channel in the range of about 300–900 mm of water.

11. The method of claim 10, wherein the air blown through said second channel creates a vacuum in said first channel in the range of about 300–900 mm of water.

12. The method of claim 11, wherein the air blown through said second channel creates a vacuum in said first channel by means of a venturi located therein.

13. The method of claim 12, wherein said withdrawal mechanism creates a vacuum in said first channel by blowing through said second channel and said withdrawal mechanism is connected to said second channel by a sealing means.

14. The method of claims 8, 9, 10, 11, 12 or 13, wherein the withdrawal means is operated for from 1 to 7 seconds.

15. An open-end spinning machine for spinning fibers from sliver into a continous length of yarn and for rejoining the yarn to the fibers, comprising:

(a) a feeding mechanism for feeding the sliver to the machine;

(b) a rotatable carder in a cavity of the machine for receiving the sliver from said feeding mechanism and for combing the sliver into fibers;

(c) a clean spinning rotor for receiving fibers from said carder and for forming a ring of fibers therein which are joined to yarn in said rotor and form yarn as the continuous length of yarn is withdrawn from said rotor;

(d) a first channel extending from said cavity through which impurities from the sliver being combed into fibers by said carder flows;

(e) a second channel connected to said first channel for creating a vacuum in said first channel for removing impurities as the sliver is combed into fibers by said carder and fed into said rotor; and (f) a fiber and impurity withdrawal mechanism, including nozzle means adapted to be operatively connected to said second channel of said machine for blowing air thereinto to increase the amount of vacuum in said first channel for removal of impurities and fibers in said cavity and from the sliver, when the yarn is rejoined to a newly deposited ring of fibers in a cleaned rotor to thereby provide the desired fibers for said rotor when the blowing of air into said second channel from said nozzle means ceases.

16. The machine of claim 15, further comprising a venturi located in said first channel for creating a vacuum when said air blows through said second channel.

17. The machine of claim 16, wherein said withdrawal means is connected to said second channel by a sealing means.

* * * * *